US007681881B2

(12) United States Patent
Kunieda et al.

(10) Patent No.: US 7,681,881 B2
(45) Date of Patent: Mar. 23, 2010

(54) SHEET ALIGNING DEVICE AND IMAGE FORMING APPARATUS

(75) Inventors: Akira Kunieda, Tokyo (JP); Masahiro Tamura, Kanagawa (JP); Makoto Hidaka, Tokyo (JP); Hitoshi Hattori, Tokyo (JP); Junichi Tokita, Kanagawa (JP); Ichiro Ichihashi, Aichi (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Hiroshi Maeda, Aichi (JP); Tomoichi Nomura, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/222,655

(22) Filed: Aug. 13, 2008

(65) Prior Publication Data

US 2009/0066003 A1 Mar. 12, 2009

(30) Foreign Application Priority Data

Sep. 6, 2007 (JP) ..... 2007-231659

(51) Int. Cl.
*B65H 33/08* (2006.01)

(52) U.S. Cl. ..... 271/221; 271/220; 270/58.01

(58) Field of Classification Search ..... 271/221, 271/220, 238; 270/58.12, 58.01, 58.27
See application file for complete search history.

(56) References Cited

U.S. PATENT DOCUMENTS 6,412,774 B1 * 7/2002 Saito et al. ..... 271/220
6,871,851 B2 * 3/2005 Tamura et al. ..... 271/221
7,014,183 B2 * 3/2006 Tamura et al. ..... 270/58.09
7,300,052 B2 * 11/2007 Tamura et al. ..... 271/221
7,344,131 B2 * 3/2008 Terao et al. ..... 270/58.08
7,451,980 B2 * 11/2008 Tamura et al. ..... 271/220
2002/0158405 A1 * 10/2002 Nagasako et al. ..... 271/213
2005/0189706 A1 * 9/2005 Tamura et al. ..... 271/221
2006/0261544 A1 11/2006 Tamura et al.
2007/0051219 A1 3/2007 Tamura et al.
2007/0138726 A1 6/2007 Tamura et al.

(Continued)

FOREIGN PATENT DOCUMENTS

JP 2002-356270 12/2002

(Continued)

OTHER PUBLICATIONS

Abstract of JP 2002-167104 published Jun. 11, 2002.

(Continued)

*Primary Examiner*—Kaitlin S Joerger
(74) *Attorney, Agent, or Firm*—Harness, Dickey & Pierce, PLC

(57) ABSTRACT

A sheet aligning device includes a sheet feeder that discharges a sheet in a first direction, a sheet tray on which the sheet is stacked, a sheet jogger that aligns the sheet on the sheet tray in a second direction perpendicular to the first direction, and a sheet detection filler that detects a state of the sheet on the sheet tray. The sheet detection filler detects a position of a topmost sheet in the stack of sheets on the sheet tray and determines an alignment position from where the sheet jogger is to begin alignment of the sheets.

17 Claims, 7 Drawing Sheets

U.S. PATENT DOCUMENTS

| | | | | |
|---|---|---|---|---|
| 2007/0147925 | A1 | 6/2007 | Nomura et al. | |
| 2007/0235917 | A1 | 10/2007 | Nagasako et al. | |
| 2008/0006993 | A1 * | 1/2008 | Nomura et al. | 271/240 |
| 2008/0048380 | A1 | 2/2008 | Ichihashi et al. | |
| 2008/0067730 | A1 | 3/2008 | Suzuki et al. | |
| 2008/0099974 | A1 * | 5/2008 | Nomura et al. | 270/58.12 |

FOREIGN PATENT DOCUMENTS

| | | |
|---|---|---|
| JP | 3973836 | 6/2007 |
| JP | 405723 | 12/2007 |

OTHER PUBLICATIONS

Abstract of JP 2002-179326 published Jun. 26, 2002.

* cited by examiner

SHEET ALIGNING DEVICE AND IMAGE FORMING APPARATUS

CROSS-REFERENCE TO RELATED APPLICATIONS

The present application claims priority to and incorporates by reference the entire contents of Japanese priority document 2007-231659 filed in Japan on Sep. 6, 2007.

BACKGROUND OF THE INVENTION

1. Field of the Invention

The present invention relates to a sheet aligning device, a sheet processing device, and an image forming apparatus.

2. Description of the Related Art

Sheet processing devices, such as finishers in image forming apparatuses, are required to have sheet aligning mechanisms for precisely aligning sheet recording media (hereinafter, referred to as "sheet(s)" as appropriate) discharged on sheet trays. For example, sheet processing devices that include sheet aligning mechanisms near sheet discharge portions are known. Those sheet aligning mechanisms align the sheets on the sheet trays.

A conventional sheet processing device is disclosed in Japanese Patent Application Laid-open No. 2002-167104. This technology provides a sheet processing device that aligns a sheet discharged from a discharging unit in a sheet discharging direction. A stacking unit of the sheet processing device is provided with an end fence, and a sheet is properly aligned when a leading edge of the sheet, which is discharged on a sheet tray by the discharging unit, hits the end fence. The sheet processing device includes a returning unit, that is, a rotation member that aligns a sheet by applying stress to the sheet on the sheet tray so that the sheet is moved toward the end fence and hits the end face. The returning unit can be set on arbitrary positions along the sheet discharging direction.

Furthermore, Japanese Patent Application Laid-open No. 2002-179326 discloses another conventional sheet processing device. This technology provides a sheet processing device that performs sorting and aligning of sheets on a sheet tray using less driving power regardless of how many sheets are present on the sheet tray. The sheet processing device includes a discharging unit that discharges a conveyed sheet, a stacking unit on which the sheet discharged by the discharging unit is stacked, and an aligning unit that aligns the sheet stacked on the stacking unit. The aligning unit includes a mechanism for aligning a sheet at a predetermined position in a direction (a shift direction) perpendicular to a sheet discharging direction and another mechanism for aligning the sheet at different positions in the shift direction perpendicular to a sheet discharging direction with respect to each stack of sheets.

Moreover, Japanese Patent Application Laid-open No. 2002-356270 discloses still another conventional sheet aligning device, an image forming apparatus, and a sheet processing device. This technology provides an aligning mechanism that can align a sheet on a sheet tray even when the sheet is curled. The sheet aligning device include a discharging unit that discharges a conveyed sheet, a stacking unit on which the sheet discharged by the discharging unit is stacked, and an aligning unit that aligns the sheet stacked on the stacking unit. The aligning unit aligns a sheet by sandwiching side edges of the sheet in a direction parallel to a sheet discharging direction. The aligning unit is rotatably supported on a rotation axis such that a base point of the aligning unit can rotate within a predetermined range. A position of the aligning unit is adjusted so that the aligning unit can sandwich the side edges of the sheet by controlling amount of rotation of the rotation axis.

However, in the conventional sheet processing devices, sheets are aligned when sheets are discharged on the sheet tray. Therefore, if curled sheets or Z-folded sheets are stacked on the sheet tray, a trailing edge of the stack of the sheets becomes thick, and a positional relationship between a shift jogger and side edges of the stack of the sheets is disturbed. This leads to degradation of precision of sheet alignment.

Furthermore, in the sheet processing device disclosed in Japanese Patent Application Laid-open No. 2002-356270, the shift jogger includes a detecting unit that detects a state of a sheet stacked on the stacking unit. However, this method is effective only in a shift mode and it is ineffective in a normal stacking mode.

SUMMARY OF THE INVENTION

It is an object of the present invention to at least partially solve the problems in the conventional technology.

According to an aspect of the present invention, there is provided a sheet aligning device including a discharging unit that discharges a sheet in a first direction; a stacking unit that receives and stacks therein the sheet discharged by the discharging unit; an aligning unit that performs an alignment operation to align the sheet stacked in the stacking unit in a second direction perpendicular to the first direction; a detecting unit that detects a sheet position of either one of a first sheet placed at a top of a stack of sheets in the stacking unit and a second sheet placed just below the first sheet; and a controlling unit that controls an alignment position at which the aligning unit is to perform the alignment operation based on the sheet position detected by the detecting unit.

According to another aspect of the present invention, there is provided a sheet aligning device including a discharging unit that discharges a sheet in a first direction; a stacking unit that receives and stacks therein the sheet discharged by the discharging unit; an aligning unit that performs an alignment operation to align the sheet stacked in the stacking unit in a second direction perpendicular to the first direction; a detecting unit that detects a position of one of the sheet in the stacking unit, a surface of a stacking unit, and a surface of a sub stacking unit arranged on the stacking unit; and a controlling unit that controls an alignment position at which the aligning unit is to perform the alignment operation based on the position detected by the detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

According to the embodiments, a discharging unit corresponds to a sheet feeder (a pair of discharging rollers) 10, a stacking unit corresponds to a sheet tray 17, an aligning unit corresponds to a sheet jogger 16, and a detecting unit corresponds to a sheet detection filler 15 and a sensor 12.

Figure 1:
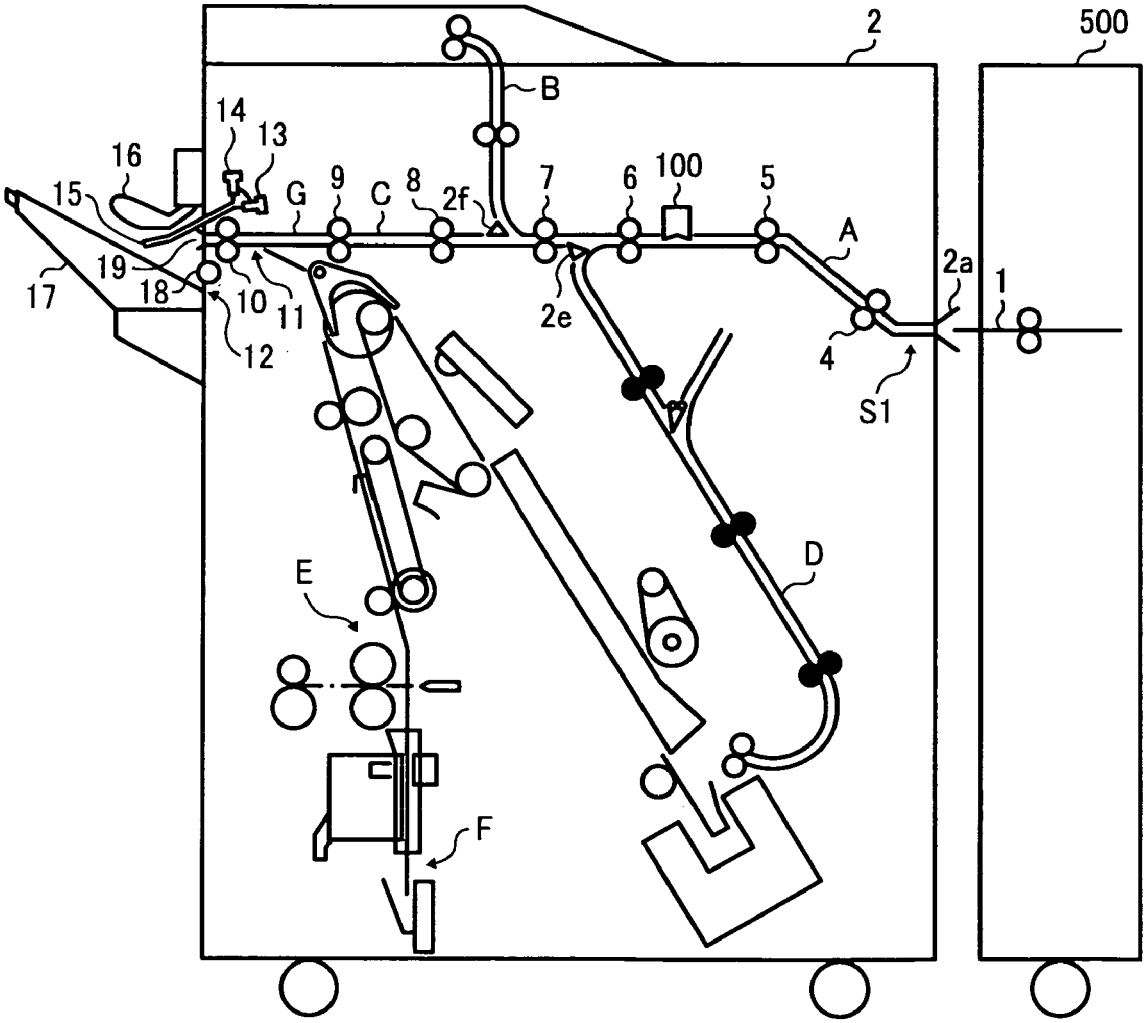
FIG. 1 is a schematic diagram of a system including a sheet processing device according to an embodiment of the present invention.

FIG. 1 is a schematic diagram of a system that includes a sheet processing device 2 according to an embodiment of the present invention. The system includes a feed mechanism that conveys sheets and a stapler mechanism that staples sheets. However, the feed mechanism and the stapler mechanism are the same as those in the conventional technologies so that they are not explained in detail below.

The system according to the embodiment includes an image forming apparatus 500 and the sheet processing device 2. The sheet processing device 2 includes a sheet conveyor path A, a proof-tray conveyor path B that leads to a proof tray, an upper conveyor path C, a staple processing path D, a center-fold processing path E, a saddle-stitch processing path F, and a sheet discharge path G. The system includes a plurality of sheet feeders, punches, staplers, folding plates, folding rollers, and the like along with the above paths.

In the system, the image forming apparatus 500 outputs a sheet 1 to a sheet inlet 2*a* of the sheet processing device 2. Then, an inlet sensor S1 detects the sheet 1, and then sheet feeders (e.g., rollers) 4, 5, 6 convey the sheet 1 along the sheet conveyor path A. The sheet 1 is further conveyed to the upper conveyor path C by rotation of switch valves 2*e* and 2*f* and a sheet feeder 7.

The sheet 1 conveyed to the upper conveyor path C is further conveyed by sheet feeders (e.g., rollers) 8, 9, 10, to the sheet discharge path G and discharged from a sheet outlet 19 to the sheet tray 17. A sheet discharge sensor 11 is arranged near the sheet outlet 19 to check the state of sheets to be discharged.

Upon stacking sheets on the sheet tray 17, the sheet processing device 2 performs control to maintain a predetermined distance between a return roller 18 and a stack of sheets by using the sensor 12 and the sheet detection filler 15 with sensors 13 and 14.

In FIG. 1, reference numeral 100 depicts a punch unit. Upon receiving a command for performing punch processing from the image forming apparatus 500, the punch unit 100 punches holes through each of the conveyed sheet.

When the sheet 1 is discharged from the sheet outlet 19, the sheet jogger 16 shifts the sheet 1 in a direction perpendicular to a sheet conveying direction before the sheet 1 falls down to the sheet tray 17. After the sheet 1 is stacked on the sheet tray 17, the return roller 18 shifts the sheet 1 in a direction parallel to the sheet conveying direction.

Figure 2:
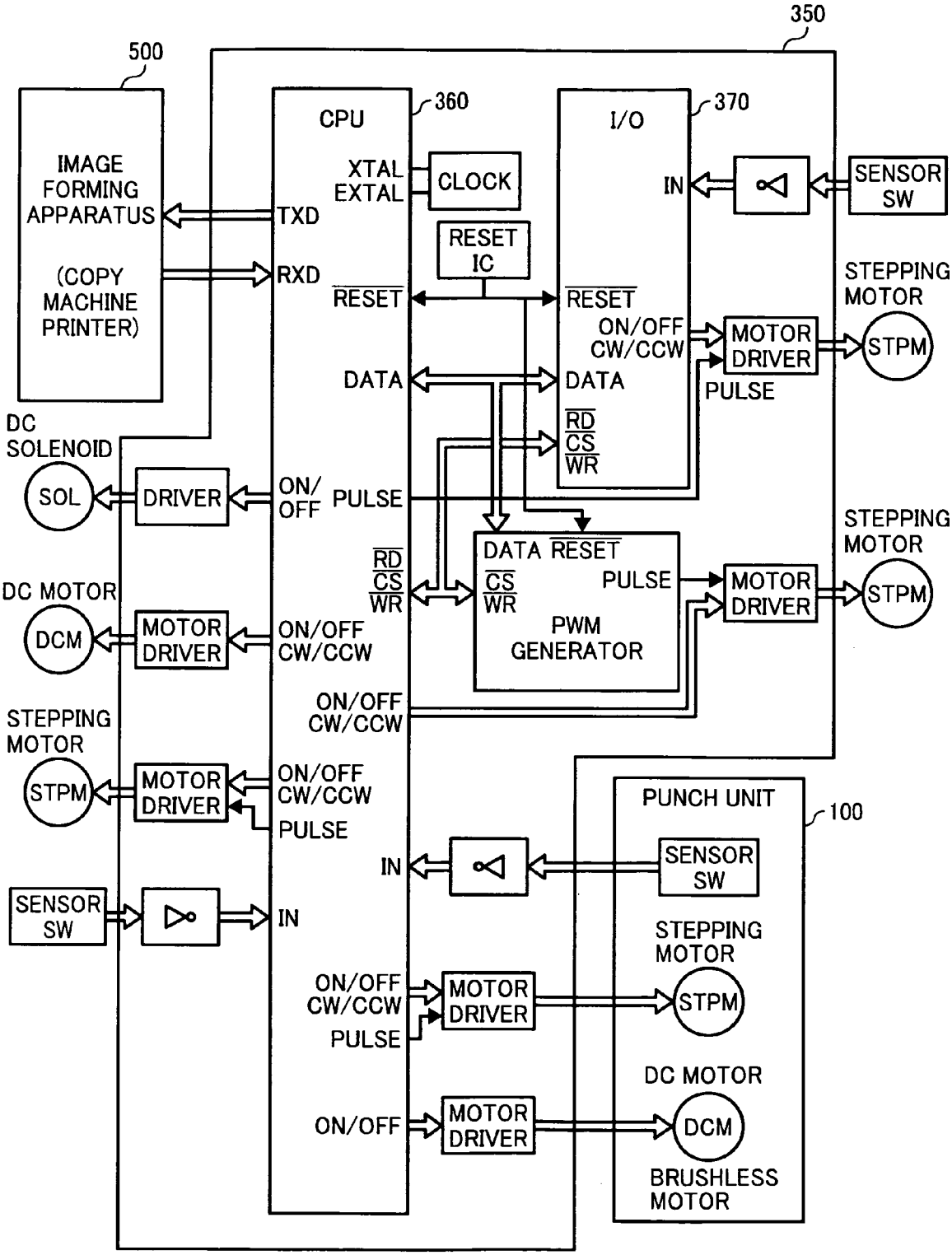
FIG. 2 is a block diagram of a control circuit in the system according to the embodiment.

FIG. 2 is a block diagram of a control circuit 350 of the sheet processing device 2. The control circuit 350 is a microcomputer that includes a CPU 360, an input/output (I/O) interface 370, and the like. The CPU 360 receives signals from various switches or buttons on a control panel (not shown) of the image forming apparatus 500, or from the sensors 12 to 14 via the I/O interface 370. The CPU 360 controls driving mechanisms based on input signals. The control processing is executed by the CPU 360 by reading computer program codes stored in a ROM (not shown), loading-read computer program codes on a RAM (not shown), and executing the computer program codes using the RAM as a work area.

Figure 3:
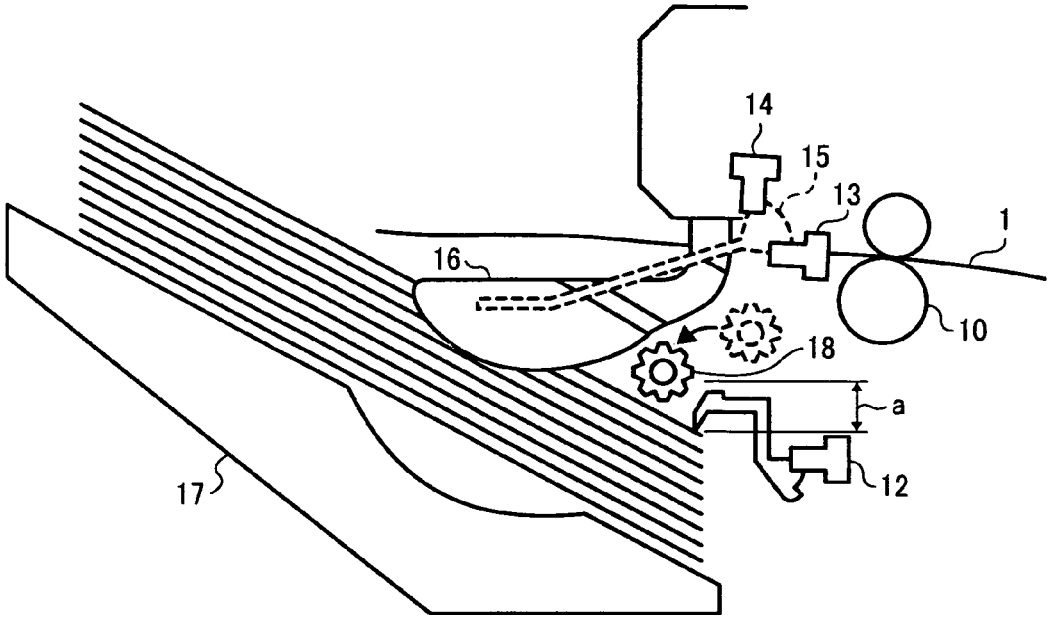
FIG. 3 is a schematic diagram for explaining sheet alignment with a conventional technology when flat sheets are stacked on a sheet tray.

FIG. 3 is a schematic diagram for explaining sheet alignment by using the sheet jogger 16 according to a conventional technology. Sheets are stacked on the sheet tray 17 in the manner described below with reference to FIG. 3.

The sheet 1 discharged from the discharging rollers 10 falls down to the sheet tray 17. The sheet 1 stacked on the sheet tray 17 is aligned in a direction perpendicular to the sheet conveying direction by the sheet jogger 16. Then, the return roller 18 aligns the sheet 1 in a direction parallel to the sheet conveying direction. Thus, the sheet 1 is aligned. A predetermined distance "a" is always maintained between the stack of sheets and the return roller 18 by using the sensor 12. Specifically, the sheet tray 17 is shifted up or down depending on whether a sheet is detected by the sensor 12.

Figure 4:
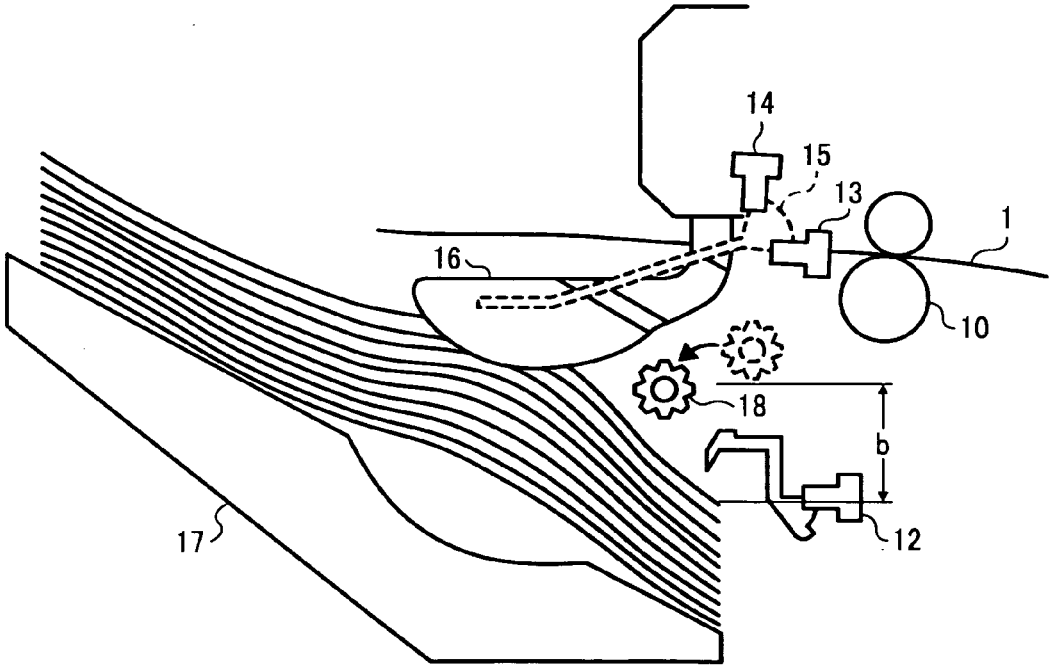
FIG. 4 is a schematic diagram for explaining sheet alignment with a conventional technology when curled sheets are stacked on the sheet tray.

FIG. 4 is a schematic diagram for explaining sheet alignment with a conventional technology when curled sheets are stacked on the sheet tray 17. The same operations are performed on the sheets as that described in connection with FIG. 3. However, if the sheets are curled, the sheet tray 17 is shifted up or down in a different manner.

If the sheets are not curled, a positional relationship between the sensor 12 and the sheet detection filler (sensor) 15 is such that the sensor 12 detects a sheet earlier than the sheet detection filler 15. However, if the sheets are curled as shown in FIG. 4, the sheet detection filler 15 comes into contact with the topmost sheet before the sensor 12 comes into contact with the sheet. In other words, the sheet detection filler 15 detects the sheet before the sensor 12 does. In the conventional technology, if the sheet detection filler 15 detects the sheet earlier than the sensor 12, the sheet tray 17 is shifted down and then the sheet jogger 16 aligns the sheet. In this case, however, the stack of sheets and the return roller 18 are separated from each other for a distance "b" which affects a sheet alignment operation.

Specifically, the distance "a" shown in FIG. 3 is longer than the distance "b" shown in FIG. 4 ($a<b$). In this state, the return roller 18 cannot come into contact with the stack of sheet so that sheet alignment in a direction parallel to the sheet conveying direction cannot be performed with the desired precision. Therefore, sheets stacked on the sheet tray 17 may fall down from the sheet tray 17. One countermeasure is to arrange the return roller 18 such that the return roller 18 comes into contact with the stack of sheets even in a situation shown in FIG. 4. However, the amount of rotation of the return roller 18 increases in this arrangement. As a result, productivity degrades.

Figure 5:
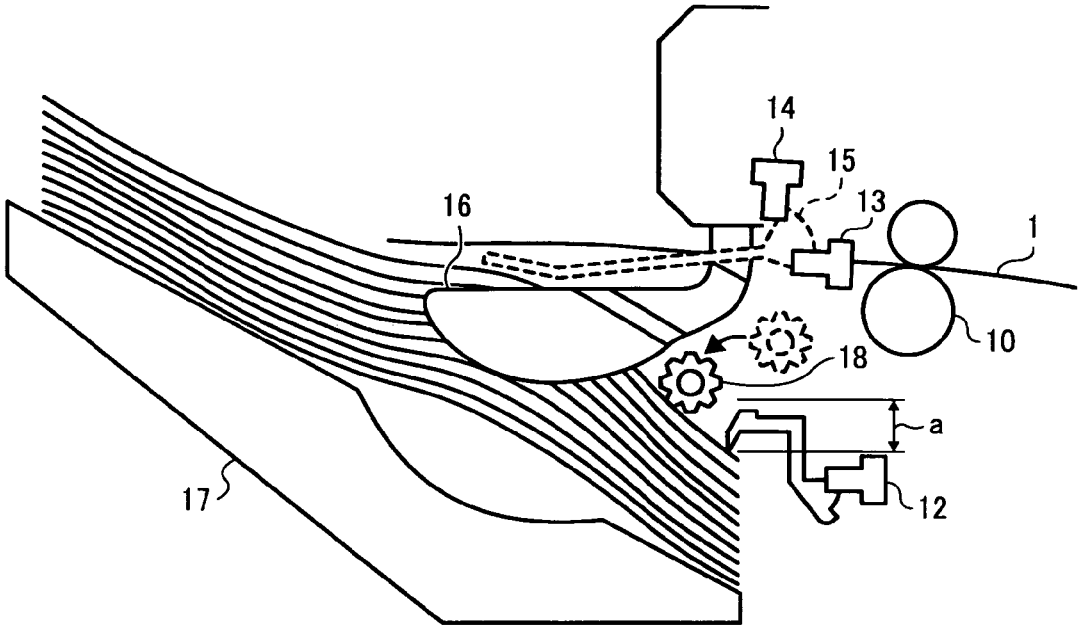
FIG. 5 is a schematic diagram for explaining sheet alignment with a conventional technology when curled sheets are stacked on the sheet tray without shifting of the sheet tray up or down by a sheet detection filler.

An example in which the sheet detection filler 15 does not shift the sheet tray 17, that is, when the sheet tray 17 is shifted up or down based on the sensor 12, is described below with reference to FIG. 5. In this case, sheets are stacked on the sheet tray 17 such that the sheet jogger 16 eats into the sheets as shown in FIG. 5. In this state, when the sheet jogger 16 jogs the sheets in the direction perpendicular to the sheet conveying direction, the sheet jogger 16 mainly aligns the sheets stacked on the sheet tray 17 and cannot handle a sheet being discharged from the discharging rollers 10. Therefore, it is difficult to align the sheet being discharged from the discharging rollers 10 on the sheet tray 17 in a desired manner.

Figure 6:
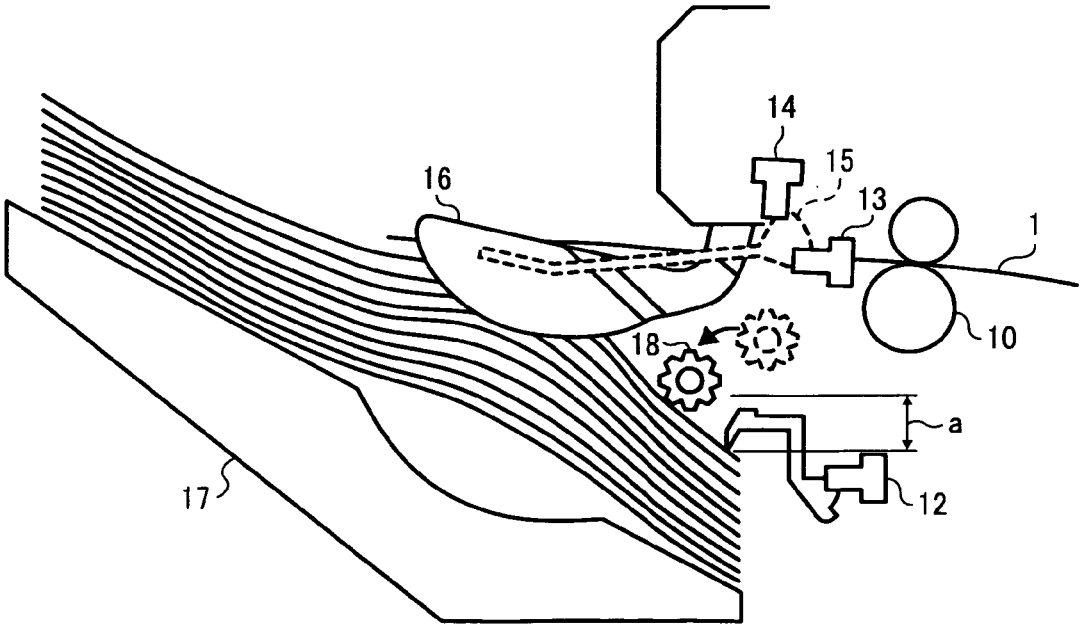
FIG. 6 is a schematic diagram of a sheet processing device according to the embodiment when curled sheets are stacked with rotation of a sheet jogger based on a sheet detection filler.

To solve the above situation, the sheet processing apparatus according to the embodiment is configured such that, when a situation shown in FIG. 5 occurs, the sheet jogger 16 rotates around a base point of the sheet jogger 16 along with the sheet detection filler 15 as shown in FIG. 6. Therefore, the sheet jogger 16 can assuredly come into contact with a side edge of a sheet placed at the top of a stack of sheets. If the sheets on the sheet tray 17 are curled as shown in FIG. 6, the angle of the sheet detection filler 15 is gradually changed in accordance with stacking of a sheet. The sensors 13 and 14 detect a positional change of the sheet detection filler 15, and then a positional angle of the sheet jogger 16 is controlled to an angle appropriate for aligning stacked sheets. A driving motor (not shown) controls the rotation of the sheet jogger 16 via a driving mechanism.

In this manner, the sheet detection filler 15, instead of the sensor 12 that detects a sheet, determines a height of a sheet placed at a top of the stack or a sheet that is placed just below the sheet placed at the top of the stack.

It is preferable to arrange the sheet detection filler 15 such that the sheet detection filler 15 can detect a center portion of a normal sheet (non-curled and non-folded sheet) as shown in FIG. 3 or a side edge of a curled sheet. If the sheet detection fillers 15 are arranged on a plurality of positions corresponding to side edges and a center portion of a sheet, sheet alignment can be performed more precisely.

The sheet jogger 16 is returned to an original position (a position shown in FIG. 3) every time one job is completed, because, a state of a next sheet to be discharged is unknown. Upon start of a next job, the sheet jogger 16 is controlled based on information from the sheet detection filler 15. Thus, it is possible to align sheets with desired precision for each job.

Figure 7:
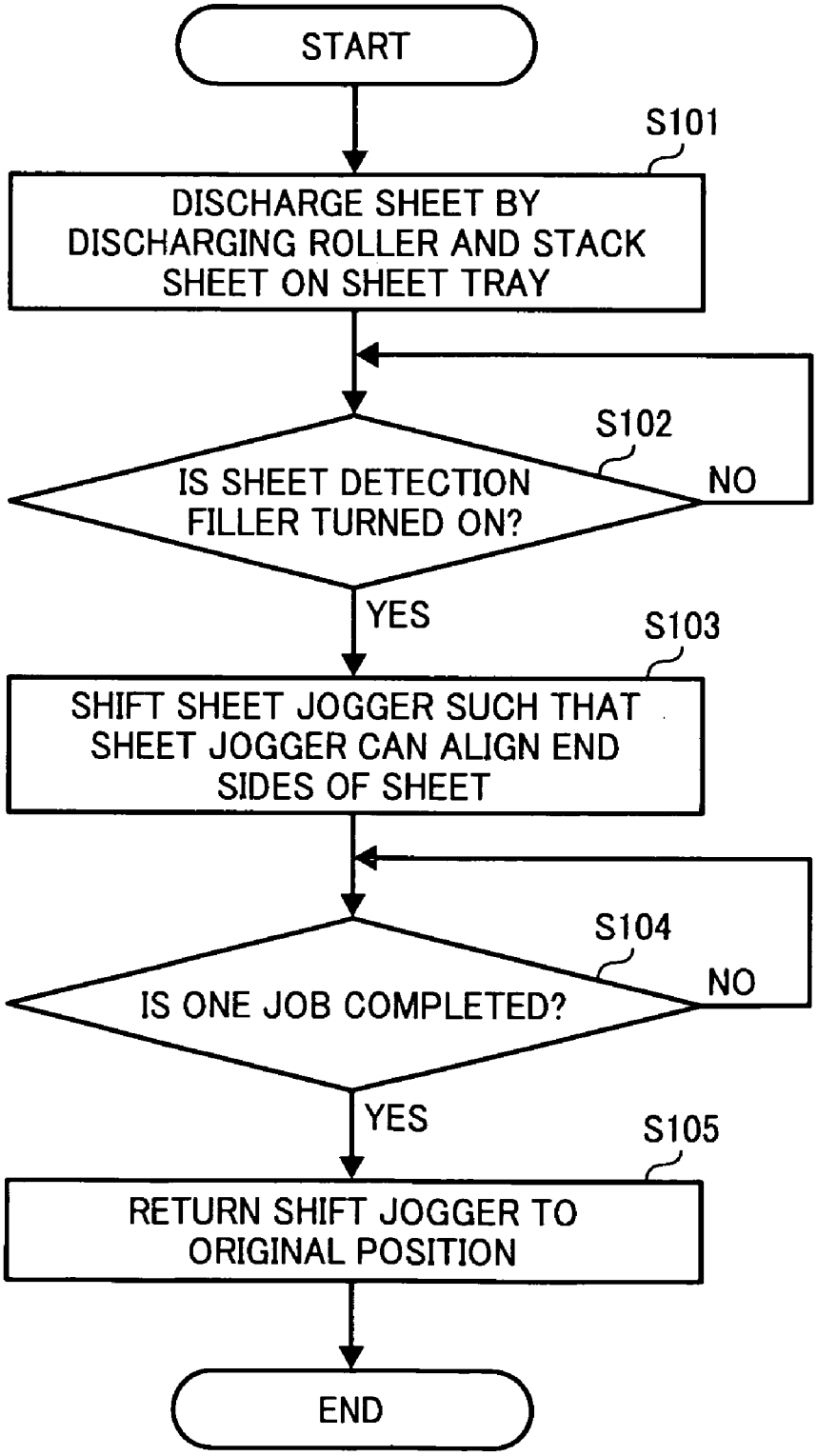
FIG. 7 is a flowchart of a processing procedure for operating the sheet jogger for each job according to the embodiment.

FIG. 7 is a flowchart of a processing procedure for operating the sheet jogger 16 for each job.

A sheet is discharged by the discharging rollers 10 and stacked on the sheet tray 17 (Step S101). It is determined whether the sheet detection filler 15 is turned ON (Step S102). When the sheet detection filler 15 is turned ON (Yes at Step S102), the sheet jogger 16 is shifted to a position appropriate for aligning side edges of a sheet (Step S103). When one job is completed (Yes at Step S104), the sheet jogger 16 returns to an original position (Step S105).

Figure 8:
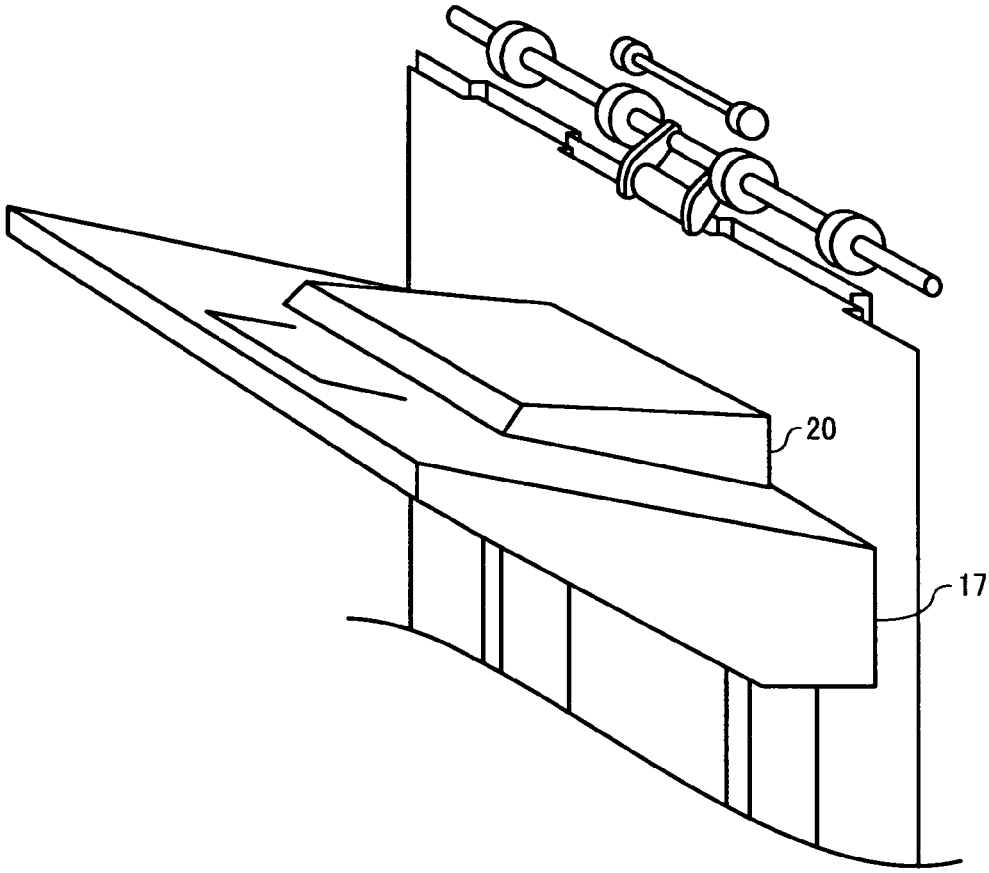
FIG. 8 is a perspective view of a discharging unit with a sub tray of the sheet processing device according to another embodiment of the present invention.
Figure 9:
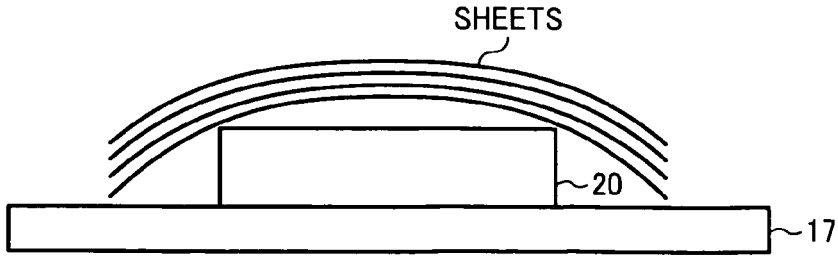
FIG. 9 is a schematic diagram for explaining what happens when large-sized sheets are stacked on the sub tray shown in FIG. 8.
Figure 10:
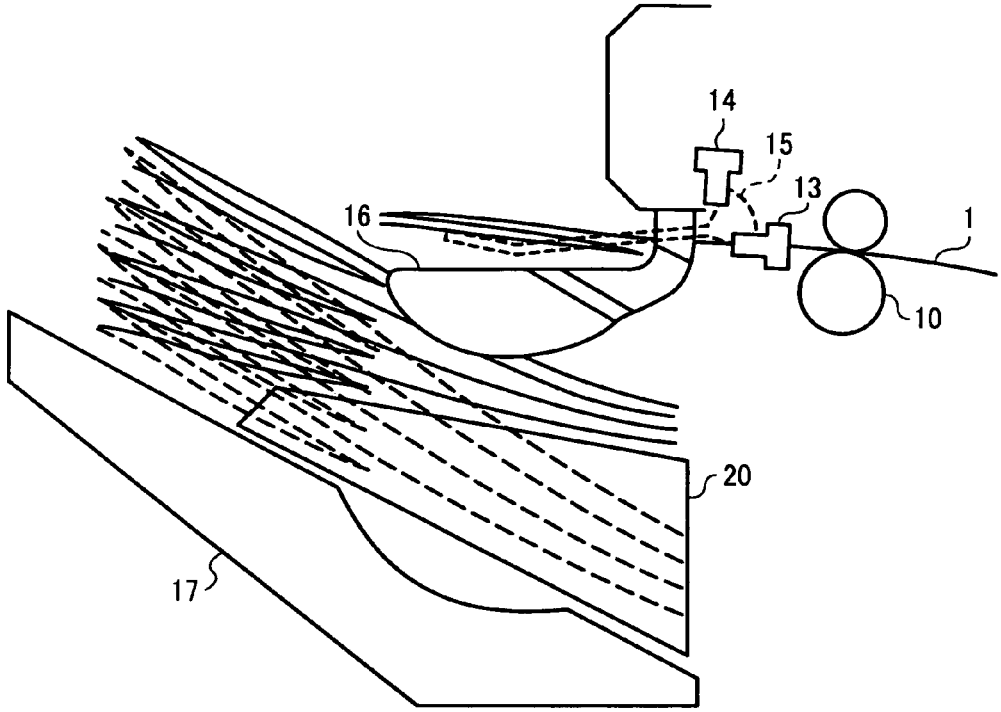
FIG. 10 is a schematic diagram for explaining sheet alignment with a conventional technology when sheets are stacked on the sub tray shown in FIG. 8.

In another embodiment, as shown in FIG. 8, a sub tray 20 is arranged on the sheet tray 17. FIG. 9 is a schematic diagram for explaining what happens when sheets are stacked on the sub tray 20. FIG. 10 is a schematic diagram for explaining sheet alignment performed on sheets stacked on the sub tray 20 using a conventional technology. The sub tray 20 is used for handling a Z-folded sheet. When the sheets are larger than the sub tray 20, the sides of the sheets fall down toward the sheet tray 17 as shown in FIG. 9. If a situation as shown in FIG. 9 occurs, a positional relationship between the sheet jogger 16 and a stack of sheets becomes such as that shown in FIG. 10. FIG. 10 is a side view of the sheet tray 17 with the sub tray 20, in which dotted lines depict fallen sides of sheets.

Figure 11:
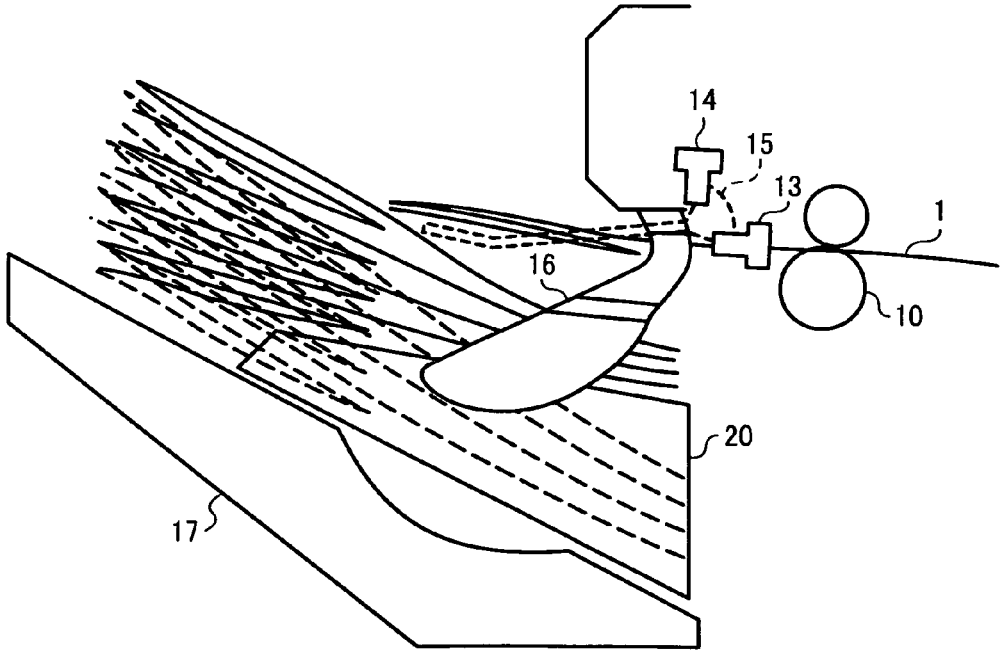
FIG. 11 is a schematic diagram of the sheet processing unit that controls sheets stacked on the sub tray by rotating a sheet jogger according to the embodiment.

A leading edge of a Z-folded sheet becomes thick because of folding. Therefore, if positions of stacked Z-folded sheets are detected by using the sheet detection filler 15 and the sheet jogger 16 is rotated and shifted as shown in FIG. 11, sheets on the sheet tray 17 are aligned in a direction perpendicular to the sheet conveying direction. At this state, because the Z-folded sheets have folded portions, a stack of Z-folded sheets gradually inclines as the number of stacked Z-folded sheets increases. Therefore, a positional angle of the sheet jogger 16 is controlled depending on inclination of the stack of Z-folded sheets to increase precision of sheet alignment. The positional angle of the sheet jogger 16 is controlled in a stepwise manner by using the sensors 13 and 14 of the sheet detection filler 15.

Only the sheet aligning function of the sheet jogger 16 has been explained above. The sheet jogger 16 also has a sorting function for sorting a bundle of sheets one by one in an alternate manner in a direction perpendicular to the sheet conveying direction for each job. In this case, the sheet jogger 16 performs sheet alignment while performing sorting operation as appropriate.

In the embodiment, sheets are aligned based on a detection state of a sheet placed at the top of a stack of sheets on the sheet tray 17 or the sub tray 20. However, a position of the sheet jogger 16 can be controlled based on a state of other sheet, such as a sheet placed just below a sheet at the top of the stack. Furthermore, at an initial state, or when sheets are removed from the sheet tray 17 or the sub tray 20 during discharging operation, sheets are not present in the sheet tray 17 or the sub tray 20. At this state, a position of a surface of the sheet tray 17 or the sub tray 20 is detected so that a position of the sheet jogger 16 is controlled based on the detected state.

As described above, according to the embodiments, sheets stacked on the sheet tray 17 can be precisely aligned by detecting a state of a sheet on the sheet tray 17 and controlling a position of the sheet jogger 16 based on a detected state of the sheet. Furthermore, stacked sheets can be precisely aligned by arranging the sheet detection filler 15 on a position suitable for detecting a state of a sheet. Moreover, stacked sheets can be aligned for each job by returning the sheet jogger 16 to an original position every time one job is completed. Thus, sheets can be precisely aligned. Furthermore, Z-folded sheets can be precisely aligned.

According to an aspect of the present invention, sheets stacked on the sheet tray can be precisely aligned.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet aligning device comprising:

a discharging unit that discharges a sheet in a first direction;

a stacking unit that receives and stacks therein the sheet discharged by the discharging unit;

an aligning unit that performs an alignment operation to align the sheet stacked in the stacking unit in a second direction perpendicular to the first direction;

a detecting unit that detects a sheet position of either one of a first sheet placed at a top of a stack of sheets in the stacking unit and a second sheet placed just below the first sheet; and a controlling unit that controls an alignment position at which the aligning unit is to perform the alignment operation based on the sheet position detected by the detecting unit, the alignment position including a positional angle of the aligning unit.

2. The sheet aligning device according to claim 1, wherein the detecting unit detects any one of a center portion and a side edge of the sheet.

3. The sheet aligning device according to claim 1, wherein the detecting unit detects a plurality of portions of the sheet along the second direction.

4. The sheet aligning device according to claim 1, wherein the controlling unit sets the alignment position corresponding to a position at which the aligning unit assuredly comes into contact with an upper side edge of the stack of the sheets in the stacking unit, the upper side edge including a side edge of the first sheet.

5. The sheet aligning unit according to claim 1, wherein the controlling unit sets the alignment position in a stepwise manner.

6. The sheet aligning device according to claim 5, wherein the alignment position changes in a stepwise manner depending on the state of the sheet detected by the detecting unit.

7. The sheet aligning device according to claim 6, wherein the alignment position changes in the stepwise manner depending on change of an angle between the aligning unit and a side portion of a stack of sheets on the stacking unit.

8. The sheet aligning unit according to claim 1, wherein the sheet is a folded sheet.

9. An image forming apparatus comprising a sheet aligning device according to claim 1.

10. A sheet aligning device comprising:

a discharging unit that discharges a sheet in a first direction;

a stacking unit that receives and stacks therein the sheet discharged by the discharging unit;

an aligning unit that performs an alignment operation to align the sheet stacked in the stacking unit in a second direction perpendicular to the first direction;

a detecting unit that detects a position of one of the sheet in the stacking unit, a surface of a stacking unit, and a surface of a sub stacking unit arranged on the stacking unit; and a controlling unit that controls an alignment position at which the aligning unit is to perform the alignment operation based on the position detected by the detecting unit, the alignment position including a positional angle of the aligning unit.

11. The sheet aligning device according to claim 10, wherein the detecting unit detects a plurality of portions of the sheet along the second direction.

12. The sheet aligning unit according to claim 10, wherein the controlling unit sets the alignment position in a stepwise manner.

13. The sheet aligning device according to claim 12, wherein the alignment position changes in a stepwise manner depending on the state of the sheet detected by the detecting unit.

14. The sheet aligning device according to claim 13, wherein the alignment position changes in the stepwise manner depending on change of an angle between the aligning unit and a side portion of a stack of sheets on the stacking unit.

15. The sheet aligning unit according to claim 10, wherein the sheet is a folded sheet.

16. The sheet aligning device according to claim 10, wherein the sub stacking unit is used for stacking a Z-folded sheet.

17. An image forming apparatus comprising a sheet aligning device according to claim 10.

* * * * *